United States Patent [19]

Swinney

[11] Patent Number: 4,768,422

[45] Date of Patent: Sep. 6, 1988

[54] PUMP MOTOR

[76] Inventor: Louis E. Swinney, 807 Medford Cir., Olathe, Kans. 66062

[21] Appl. No.: 907,576

[22] Filed: Sep. 15, 1986

[51] Int. Cl.[4] ..... F01B 13/06

[52] U.S. Cl. ..... 91/497; 417/221

[58] Field of Search ..... 417/221; 91/486, 487, 91/491, 497

[56] References Cited

U.S. PATENT DOCUMENTS

| | | | |
|---|---|---|---|
| 1,709,194 | 4/1929 | Hele-Shaw et al. | 91/497 |
| 1,757,483 | 5/1930 | Hele-Shaw et al. | 91/497 |
| 1,904,653 | 4/1933 | Davis et al. | 91/497 |
| 2,045,330 | 6/1936 | MacMillin | 91/497 |
| 2,350,683 | 6/1944 | Jossim et al. | 91/496 |
| 2,397,314 | 3/1946 | Grosser | 91/485 |
| 2,651,999 | 9/1953 | Harrington | 91/496 |
| 2,680,412 | 6/1954 | Entwistle | 417/221 |
| 2,932,256 | 4/1960 | Orshansky, Jr. | 91/485 |
| 3,096,723 | 7/1963 | Puryear | 91/485 |
| 3,124,079 | 3/1964 | Boyer | 91/505 |

*Primary Examiner*—William L. Freeh

*Attorney, Agent, or Firm*—Kokjer, Kircher, Bradley, Wharton, Bowman & Johnson .

[57] ABSTRACT

A hydraulic pump or motor having a rotor carrying radially disposed pistons. In one embodiment, the connection for introducing and withdrawing fluid at the rotor is made by manifolds which are in complemental, sliding contact against a surface of the rotor. Piston-like projections on the manifold are exposed to the pressurized fluid flowing through the apparatus to hold the manifolds in tight sealing engagement against the rotor surface. The effects of centrifugal force on the operation of the apparatus are minimized by mechanically securing the pistons against outward radial movement during high speed rotation, and by admitting and withdrawing fluid at locations relatively near the axis of rotation of the rotor. An alternate embodiment is disclosed which has a floating rotor so that the pressure of the operating fluid is used to effect a tight seal at the junction of the stationary and rotating components in the high pressure region.

1 Claim, 4 Drawing Sheets

PUMP MOTOR

This invention relates to force transmitting apparatus, and more particularly to a hydraulic pump or motor of the type having a plurality of radially disposed reciprocating pistons carried by a rotor. Apparatuses of this type are used for effecting a relationship between torque and fluid pressure. If the apparatus is used as a pump, torque is applied to turn the rotor and fluid in the apparatus is pressurized by the pistons, thereby creating a pumping action. On the other hand, if the apparatus is to be used as a motor, pressurized fluid is applied to the pistons to cause the rotor to turn. Torque from the rotor is available for whatever purposes desired.

Since the principles involved in this invention generally are equally applicable to apparatuses of this type whether used as pumps or motors, such apparatuses are referred to herein generically as "force transmitting apparatuses for effecting a relationship between torque and fluid pressure". Whenever specific reference is made in the description to the apparatus as a pump or as a motor, it should be understood that either the pumping or the motor functions where applicable.

Pumps and motors utilizing pistions are well knwon. such reference is for purposes of illustration and may embrace Pistons operating within chambers are capable of achieving relatively effective characteristics and, by determining the diameter and the stroke, the displacement of such pumps and motors can be calculated with reasonable accuracy. For this reason, piston type units are called positive displacement pumps and motors. Gear type units, as well as vane and centrifugal pumps and motors, are not in this category and are not pertinent to a comparison of piston units.

Piston type pumps and motors are of two general categories, axial piston types in which the pistons reciprocate parallel with the driven or driving axle or shaft and radial piston pumps and motors in which the pistons reciprocate or rotate perpendicularly with the driven or driving shaft.

Axial piston units have heretofore been widely accepted as the more practical of the two types. They have been produced in a wide range of sizes with varying designs and in both fixed displacement and variable displacement ccnfigurations. These units have been designed and redesigned and improved upon for many years and have reached a high degree of efficiency and sophistication.

Radial units, on the other hand, have been deemed to have inherent problems which heretofore have remained insoluble. Therefor, the development of the radial piston concept has been largely neglected and remains in a relatively unsophisticated state.

While axial piston type units are in a highly developed state, there are certain advantages to be achieved in the use of radial piston type units for many applications. Radial piston units can be made more compact, lighter in additional advantages of the radial type over axial types units will become apparent in the description of my invention. weight, and less expensive than axial piston units. Further, There are at least two easily recognizable problems with the radial piston design. One of these is the inherent problem of introducing fluid to the pistons into the outer periphery of a rapidly spinning rotor. To operate such a unit as a pump, it is first necessary to overcome the tendency of the liquid to be expelled by centrifugal force before the rotor can receive fluid to be pressurized.

Another problem has been encountered in effectively sealing the ports or ducting between the stationary components and the rotating or moving components. This problem is compounded by the necessity to provide tolerance between the moving and stationary components to assure freedom for relative movement between these components as relatively high temperatures from fluid compression cause the components to expand. The necessary tolerances have, in the past, allowed leakage to occur at these ports. The efficiency of units of this type is diminished by any such leakage or loss of pressurized fluid.

The purpose of my invention is to provide a radial piston fluid pump or motor which overcomes the problems outlined above and to further provide distinct advantages not found in any other unit of the type described.

Accordingly, it is a principal object of the present invention to provide an apparatus of this type which is constructed in a manner to overcome the disadvantages of heretofore available devices, yet which may be economically manufactured and which is capable of relatively efficient operation.

Another important object of this invention is to provide a relatively non-complex, economical means for effectively sealing the fluid conduit junction between the rotating and stationary parts of a radial piston apparatus for more efficient operation than has heretofore been reasonably achievable.

In the attainment of the foregoing objective, it is another important object of the present invention to provide a construction wherein the pressure of the fluid involved in the operation of the apparatus may be utilized to provide an adjustable junction which accommodates expansion caused by heating to insure the maintenance of an effective seal at the junction during operation of the apparatus.

Still a further object of my invention is to provide a method of interconnecting the pistons with the cam in a manner to minimize friction.

Another purpose of this invention is to provide a radial piston unit which can be built as a fixed displacement unit and is easily convertible or modifiable to a variable displacement device.

Still another purpose of this invention is to provide a unit of the type described which can be utilized both as a pump and motor without the necessity for modification.

Still another purpose of this invention is to provide a unit of the type described in which the displacement volume can be changed with a minimum of force.

Another purpose of this invention is to provide an apparatus of the type described wherein the rotor, having passages from an inward location to a peripheral area in the rotor, will act to utilize centrifugal force to reduce or eliminate the need to impart a high degree of pressurization to the inlet port of the apparatus while it is operating as a pump.

Many variations of the apparatus herein contained can be effected without departing from the spirit of the invention. The following description discloses two embodiments of similar concept, the first being a more elaborate apparatus for operating at high speeds. The other apparatus is simple in design but will work efficiently when used at lower rotational speeds. Where only lower speeds are required, the second unit will provide greater economy.

These and other important aims and objectives of the present invention will be further explained or will be apparent from the description and explanation of the figures of the drawings, wherein.

Figure 1:
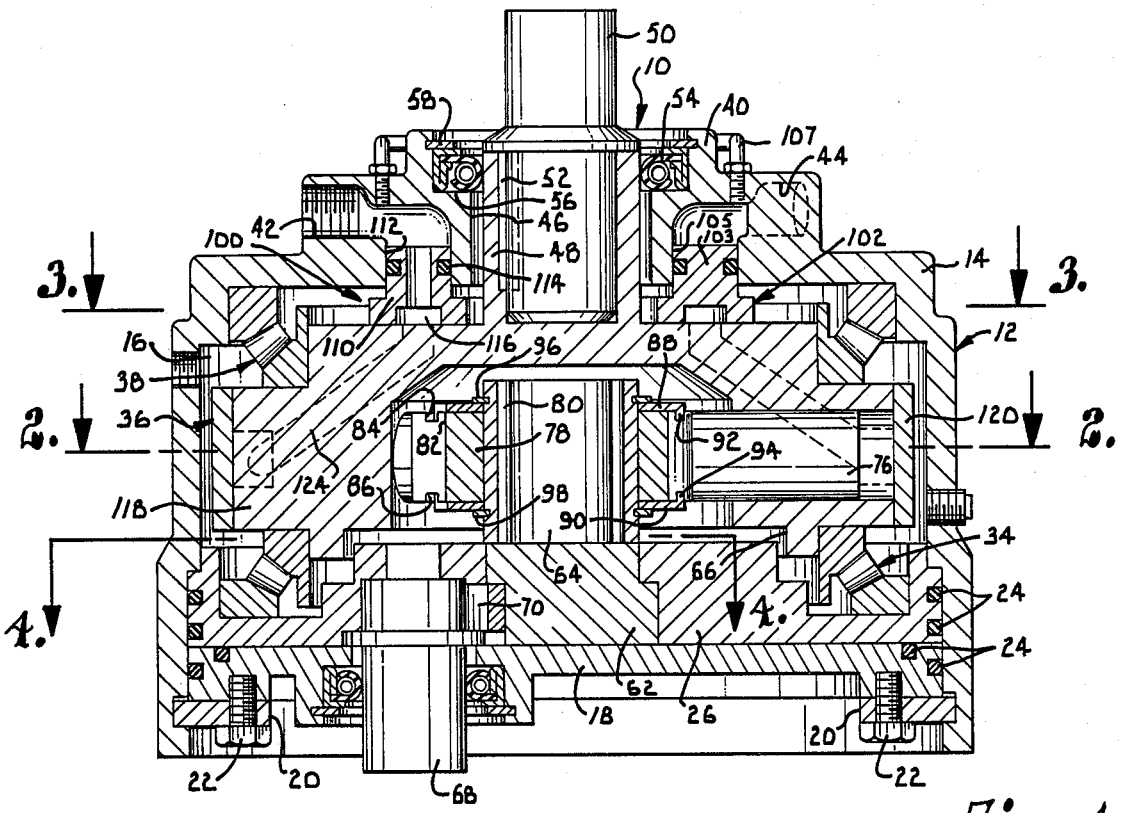
FIG. 1 is a detailed, vertical cross-sectional view through an apparatus embodying the principles of this invention.

Apparatus embodying the principles of this invention is broadly designated by the reference numeral 10 and is illustrated in FIGS. 1 through 6 of the drawing. Apparatus 10 includes a housing 12 comprised of an inverted cup-shaped closure 14 having a circular internal cavity 16 defined by the side wall of closure 14 and by a mounting member 26 extending across the closure. An end plate 18 immediately below member 26 closes the housing as shown in FIG. 1 of the drawings. Plate 18 is held in proper position by a plurality of retainers 20 as illustrated. Bolts 22 threadably received in retainers 20 project against the bottom surface of plate 18 to adjustably position the latter as required. A plurality of seals 24 in their respective annular grooves as illustrated, seal the cavity against the escape of fluid.

Member 26 is configured to mount an annular, tapered bearing 34 which, in turn, rotatably mounts a rotor 36 in chamber 16 for rotation about an axis along the center line of the circular housing cavity. A second annular tapered bearing 38 seated on the side opposite rotor 36 from bearing 34 and against the upper corner of cavity 16 cooperates with bearing 34 to mount the rotor in its proper position for spinning within the cavity.

An internal, upwardly extending projection 40 on housing 14 is provided with internally threaded passages 42 and 44 presenting the fluid inlet and outlet ports for apparatus 10. A bore 46 through projection 40 extends axially of cavity 16 and rotor 36 to receive an upwardly extending tubular extension 48 integral with rotor 36 as shown. An output shaft 50 for apparatus 10 is keyed to extension 48 by key 52 so that shaft 50 rotates with rotor 36. It will be apparent, of course, that the outwardly projecting end of shaft 50 may be configured or splined as necessary to permit rotation of the shaft by an external source or to permit the rotation of an external member by the shaft as may be desired. A fluid seal 54 is held in an annular shoulder 56 in projection 40 around bore 46 by retainer 58 to seal against the egress of fluid from cavity 16 between the bore and rotor extension 48.

Figure 4:
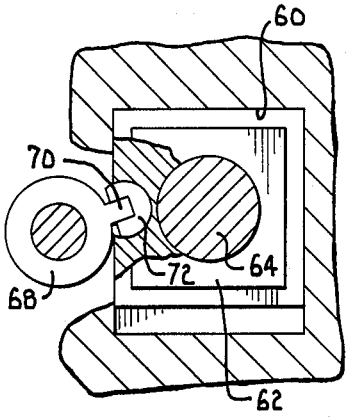
FIG. 4 is a fragmentary detailed cross-sectional view taken along line 4—4 of FIG. 1, parts being broken away to reveal details of construction.
Figure 6:
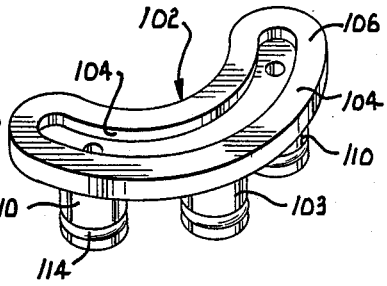
FIG. 6 is an enlarged, top perspective view of one of the manifolds shown in inverted position to reveal details of construction.
Figure 5:
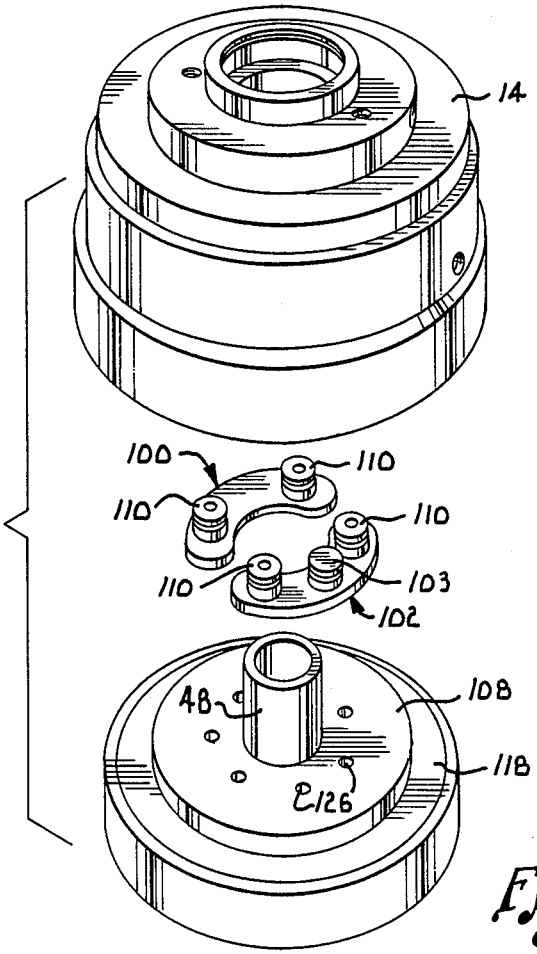
FIG. 5 is an exploded top perspective view illustrating the configuration and relationship of the rotor, housing and manifolds of the apparatus of FIG. 1.
Figure 9:
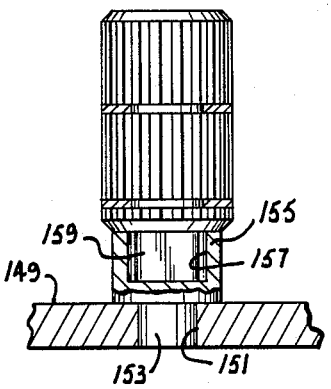
FIG. 9 is a fragmentary, detailed cross-sectional view taken along line 9—9 of FIG. 7.
Figure 7:
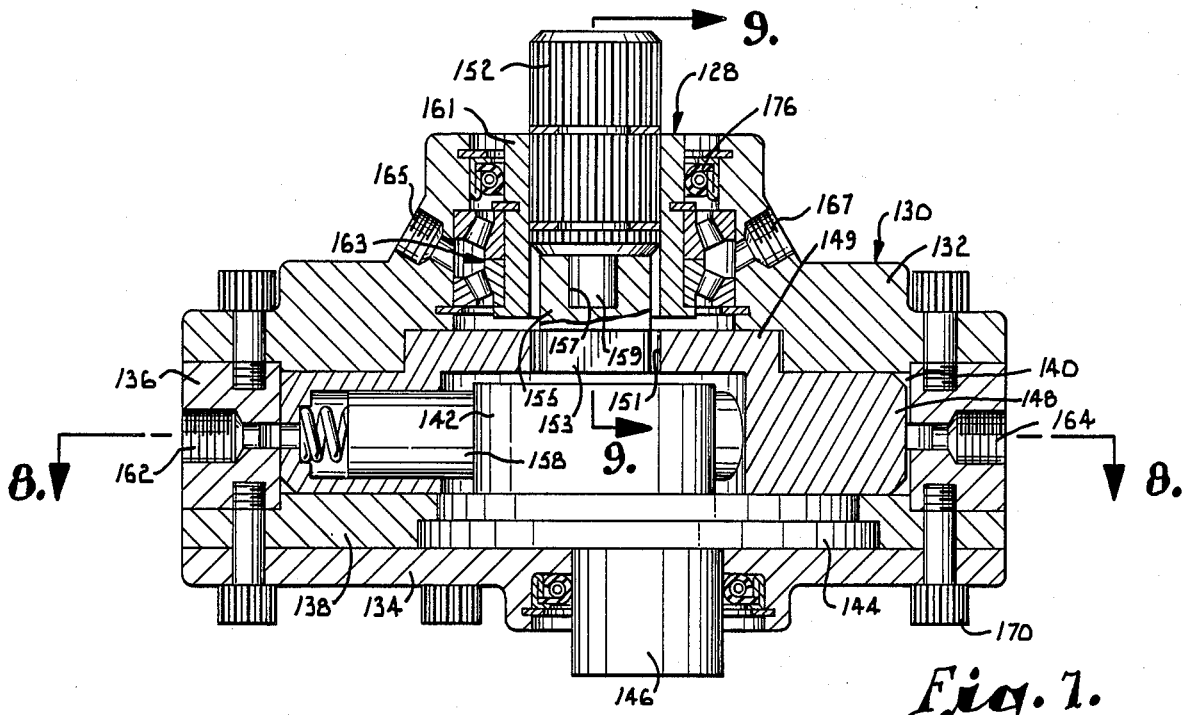
FIG. 7 is a view similar to FIG. 1 but illustrating an alternate embodiment of an apparatus incorporating some of the principles of the invention.
Figure 8:
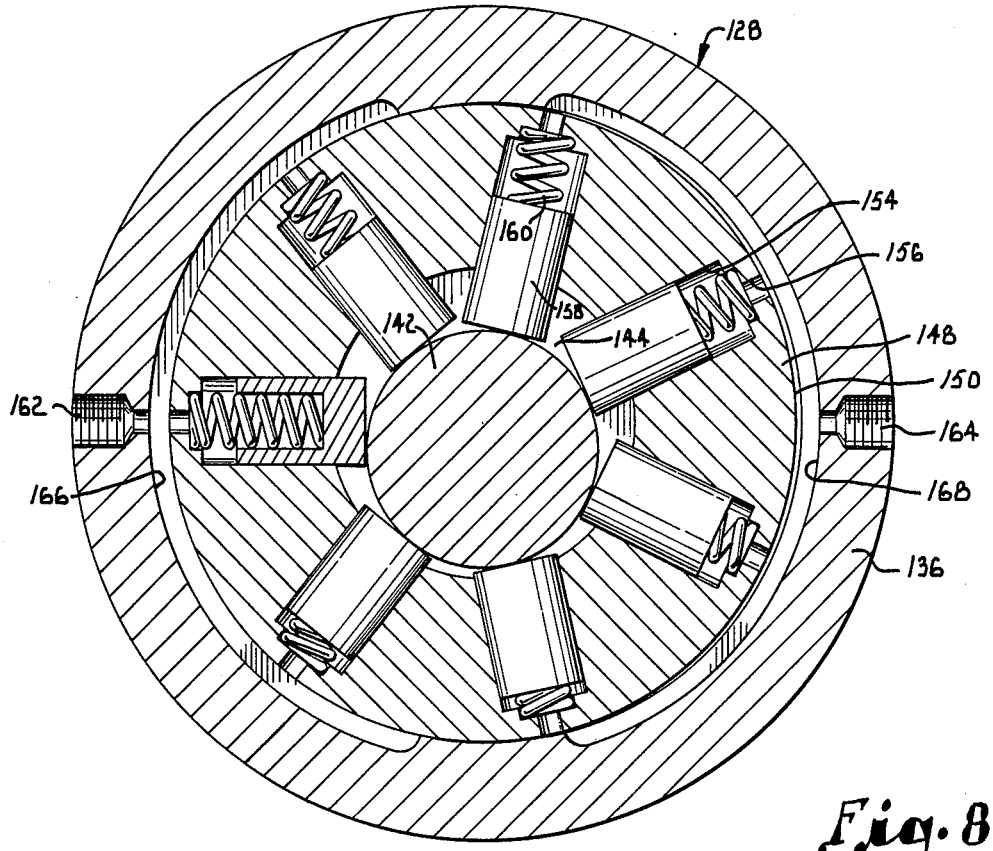
FIG. 8 is a detailed cross-sectional view taken along line 8—8 of FIG. 7, certain parts being broken away and shown in cross-section to reveal details of construction.

Referring now more especially to FIGS. 1 and 4 of the drawing, mounting member 26 is provided with a centrally positioned rectangular opening 60 which receives a sliding block 62 having an integral, upwardly extending circular shaft 64 projecting into a central opening 66 extending from the bottom of rotor 36 partially through the latter as shown in FIG. 1. Block 62 and opening 60 are configured with complementally engaged shoulders as shown in the drawings to permit limited rectilinear sliding movement of the block and its integral shaft 64 within opening 60 along an imaginary line bisecting the rotor between the fluid inlet and outlet sides of the apparatus for a purpose to be hereinafter described.

A shaft 68 extending parallel with shaft 64 is rotatably mounted in member 26 adjacent block 62 and extends outwardly through baseplate 18 as shown. A projection or boss 70 extending laterally from shaft 68 is fitted in a notched element 72 having a semi-circular outer surface. Element 72 is complementally received in an arcuate notch in the edge of block 62 so that rotation of shaft 68 effects shifting of the block and shaft 64 with respect to member 26 along its limited rectilinear path of travel.

Figure 2:
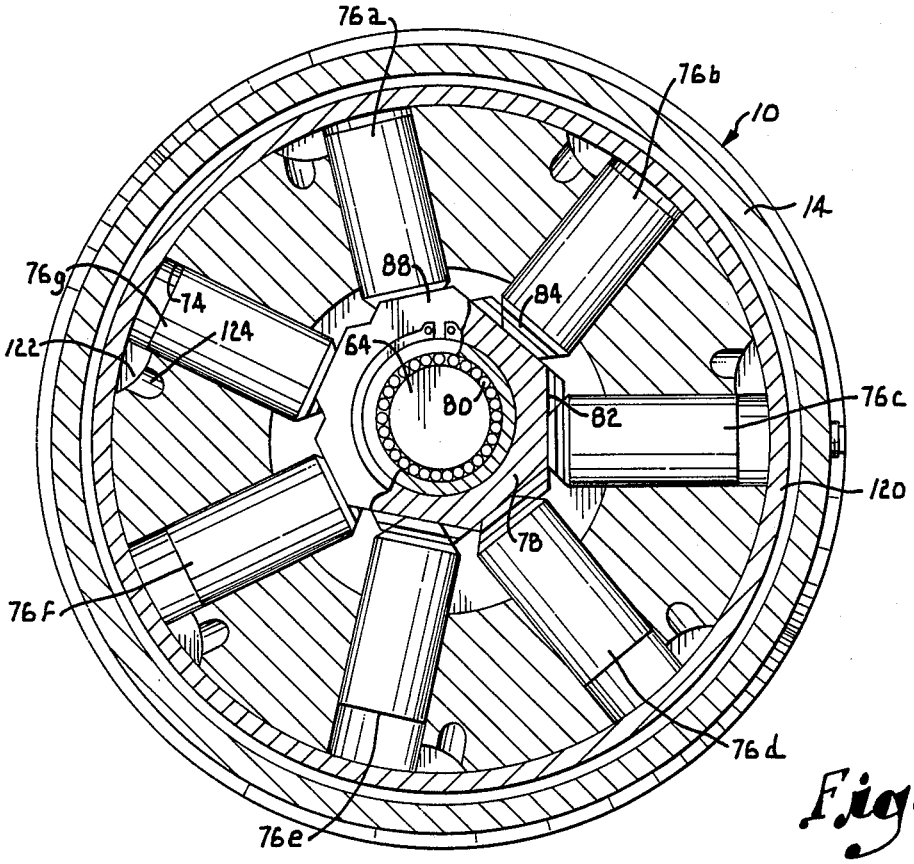
FIG. 2 is a detailed cross-sectional view taken along line 2—2 of FIG. 1, parts being broken away to reveal details of construction.

Rotor 36 is configured as shown in FIG. 2 to provide a plurality of radially extending cavities or cylinders 74 spaced uniformly circumferentially around the rotor. The number of cylinders provided for the rotor may be varied in accordance with the performance requirements for the apparatus but an odd number of cylinders are required. In the embodiment illustrated, seven cylinders 74 are provided in rotor 36. The respective cylinders are identical and each receives therein its corresponding piston 76, the respective pistons being designated 76*a* through 76*g* in the drawings. The respective pistons are mounted in their corresponding cylinders for reciprocation along the longitudinal axes of the cylinders which extend radially of rotor 36.

Means to effect reciprocation of the pistons during rotation of the rotor includes a polygonal element 78 mounted for rotation about shaft 64 by a needle bearing 80. Since the rotor 36 of apparatus 10 has seven piston and cylinder assemblies, element 78 is septagonal to provide a flat face 82 on the outer peripheral surface of the element for each assembly. The innermost end of each piston 76*a* through 76*g* rests flatly against its corresponding face 82. The upper and lower surfaces of the innermost ends of the respective pistons are shaped to provide a pair of parallel grooves 84 and 86. A pair of retainers 88 and 90 are received over shaft 64 and have a plurality of terminal projections 92 and 94 received in the corresponding grooves 84 and 86 as shown best in FIG. 1 of the drawing. Manifestly, there is a projection 92 and 94 on the respective retainers 88 and 90 for each of the grooves 84 and 86 of each piston respectively. The retainers 88 and 90 are maintained in proper position by snap rings 96 and 98.

The retainers 88 and 90 serve to hold the pistons in fixed position radially outwardly from the axis of shaft 64 as the pistons rotate about the shaft. However, the innermost end of each piston is permitted to slide rectilinearly along its corresponding flat face of element 78 during such rotation by virtue of the groove and projection connection between the retainers and the pistons. Such sliding movement along the flat faces of element 78 is necessary during rotation of the rotor and the element when the axis of rotation of the element does not coincide with the axis of rotation of the rotor. During operation of apparatus 10, the axis of rotation of the element will normally be spaced from and parallel with the axis of rotation of rotor 36 to effect relative reciprocation of the pistons in their respective cylinders.

Means to conduct fluid to and from the respective cylinders in the rotor during operation of apparatus 10 is provided in the form of a pair of elongated, arcuate manifolds 100 and 102 shown best in FIGS. 1, 3, 5 and 6 of the drawing. These manifolds are similar in general design, however manifold 102 has an additional piston for a purpose to be explained later. Each of the manifolds has an elongated, continuous peripheral wall 104 provided with a flat lowermost surface 106 slidingly engaged on the flat uppermost surface 108 of rotor 36. Each manifold 100 and 102 has a pair of cylindrical, integral, upwardly extending, piston like projections 110 which are slidingly received in corresponding cylindrical bores 112 extending upwardly through the upper wall of housing closure 14 and in communication with the corresponding inlet and outlet passages 42 and 44. Peripheral seals 114 for each projection restrict flow of fluid through the projections to the axially extending conduits in the projections. The tubular projections 110 have relatively thick side walls as shown in the drawing and the total surface area presented by the uppermost ends of both projections for each manifold is greater than the total surface area of the groove 116 defined by the inner perimeter wall 104 of the manifold.

As heretofore mentioned, manifold 102 is provided with an additional piston like projection 103 intermediate the projections 110 and identical to the latter except that projection 103 is not provided with an axial passage therethrough. Projection 103 is similarly slidably received in its corresponding bore 105 formed in housing closure 14. A pipe 107 communicates between bore 105 above piston projection 103 and fluid port 42. Inlet fluid pressure is applied in this manner to the outlet manifold 102 to provide additional force to this manifold as will become more apparent in the following description. Such additional force is required to overcome the kinetic force applied to the opposite side of manifold 102 by the rushing fluid as the latter is expelled from the rotor.

Rotor 36 is comprised of a relatively massive member 118 which is bored to provide the radially extending cavities or cylinders 74. A circumferentially extending band 120 is fitted around member 118 for rotation with the latter. Band 120 serves to close the open ends of the respective cylinders 74 as shown in the drawings. Member 118 is configured as shown best in FIG. 2 with an arcuate recess 122 adjacent each cylinder 74 to provide a fluid inlet port for the outermost end of each cylinder. Each recess 122 is, in turn, provided with its respective fluid passage 124 extending inwardly from the outer periphery of member 118 and terminating in a port 126 opening onto the flat surface portion 108 of rotor member 118. Each cylinder 74 has its corresponding passage 126 drilled or otherwise formed internally of member 118 and terminating in its corresponding port 126. The respective ports 126 for all of the passages are arranged in a circular pattern substantially inboard of the periphery of the rotor and concentric with the axis of rotation of the latter. The respective manifolds 100 and 102 are configured so that the downwardly opening cavities 116 of the respective manifolds extends along a portion of the path of travel of the ports 126 as the rotor is rotated. Further, the manifolds are sufficiently long that each manifold cavity simultaneously communicates with a plurality of ports 126. In the construction of apparatus 10 illustrated, each manifold is long enough to simultaneously communicate with three mutually adjacent ports 126.

In operation of apparatus 10, assuming that the apparatus is to be used as a hydrostatic motor, pressurized fluid from an external source (not shown) is applied to inlet port 42. The pressurized fluid applied through the inlet to the upper surfaces of both projections 110 of manifold 100 force the projections downwardly in their respective bores. Inasmuch as the combined surface areas of the heads of the piston-like projections or the cross-sectional area of the projections is greater than the surface area at the top of the manifold groove or chamber 116, manifold 100 is held in tight, fluid sealing disposition against the flat surface 108 of rotor member 118. The projections 110 and their corresponding bores serve as fluid operated piston and cylinder assemblies to effect a fluid tight juncture between the manifold and the rotor. The greater the pressure of the fluid, the greater is the force effecting the seal.

Those cylinders 74 having ports 126 beneath manifold 100 are supplied with pressurized fluid traveling through the respective passages 124 and recesses 122 into the outer ends of the cylinders. Obviously, the cylinders connected to ports 126 which are not positioned in communication with cavity 116 of manifold 100 are not provided with pressurized fluid at this time.

With the axis of shaft 64 offset with respect to the axis of rotation of rotor 36, the introduction of pressurized fluid at the outer end of certain of the pistons causes an imbalance of forces as a result of the relative eccentricity of the shafts. This causes the rotation of rotor 36 about its axis in the manner well known in apparatus of this type. The pistons are constrained to rotate about the axis of shaft 64. Rotor 36 is constrained to rotate about the central axis of chamber 16 by its mounting in the chamber on bearings 34 and 38. This arrangement results in relative reciprocation of the pistons in their corresponding cylinders during each revolution of the rotor.

As each port 126 moves from beneath manifold 100 as the rotor turns, the fluid communication through chamber 116 to that port and its associated cylinder is terminated and another of the ports 126 moves into fluid communication with the pressurized fluid in manifold 100. A constant number of working pistons is kept at all times in fluid communication with the manifold. Once a previously pressurized cylinder has rotated to a position where its respective port 126 is in communication with the chamber 116 of the other manifold 102, the fluid in that cylinder is vented through the manifold to the outlet port 44 and to a discharge reservoir (not shown) adapted to communicate with the outlet port. Again, the fluid pressure acting on the upper ends of the hold-down pistons or projections 110 maintain a fluid tight, sliding seal between manifold 102 and the flat upper surface of rotor 36. Further, the force of fluid from inlet port 42 through pipe 107 acting against piston projection 103 provides additional force against manifold 102 as has been pointed out. This holding force is needed to offset the kinetic force of the out rushing fluid which would otherwise prevent the maintenance of an effective seal at the juncture between the manifold and the rotor.

The amount of eccentricity between shaft 64 and rotor 36 can be varied within limits by rotating shaft 68 to slide block 62 in member 26 as will be readily apparent. The greater the spacing between the respective axes of rotation, the greater the stroke provided for each piston during rotation of the rotor. Further, the greater the stroke of the respective pistons, the greater the torque imparted to the said rotor 36 and the output shaft 50. Correspondingly, the shorter the stroke of the pistons the faster the speed which is imparted to the rotor for a given volume of pressurized fluid.

It will be understood by those skilled in the art that the foregoing description of apparatus 10 functioning as a motor presents no difficulty in that fluid under great pressure will be forced into the inlet side of the unit to accomplish the function of operating the unit as a motor. To operate the unit as a pump the unit must receive fluid into the inlet port under little or no pressure and deliver pressurized fluid at the outlet port. While in operation as a pump an additional phenomenon is demonstrated by apparatus 10. As fluid is introduced into the rotor through the ports ducted by manifold 126, it is then rotated rapidly within the rotor which causes it to be forced outwardly by centrifugal force to the periphery of the rotor. This results in a certain suction occurring at the inlet port 42. This phenomenon assures a steady flow of fluid into the unit as long as fluid is present at port 42, whether delivered there by pressure or not.

Unlike other units with rotating piston carriers, it is not necessary to force feed the unit. All other piston units in which the piston chambers revolve require a certain pressure to introduce fluid into the working chambers. It is therefor necessary in such units to maintain a closed loop circuit which has a certain pressure at all times. A loop pressure of 150 psi will result in a loss of working pressure of 150 psi since pressure at the outlet port is the same as throughout the circuit.

When used as a pump, apparatus 10 will respond to the sliding of block 62 in member 26 to change the eccentricity of the cam 64 which changes the length of the stroke of the pistons thereby varying the volume of the pump to the desired amount.

Apparatus 10 is constructed in a manner to make adjustments of the cam relatively easy. Movement of the cam changes the displacement of the pistons in accordance with the degree of eccentricity between the cam and the axis of rotation of the rotor. The cam is movable along a line extending in a direction oriented with respect to those pistons under pressure during operation of the unit as to hold the amount of force required to effect cam movement to an absolute minimum.

Figure 3:
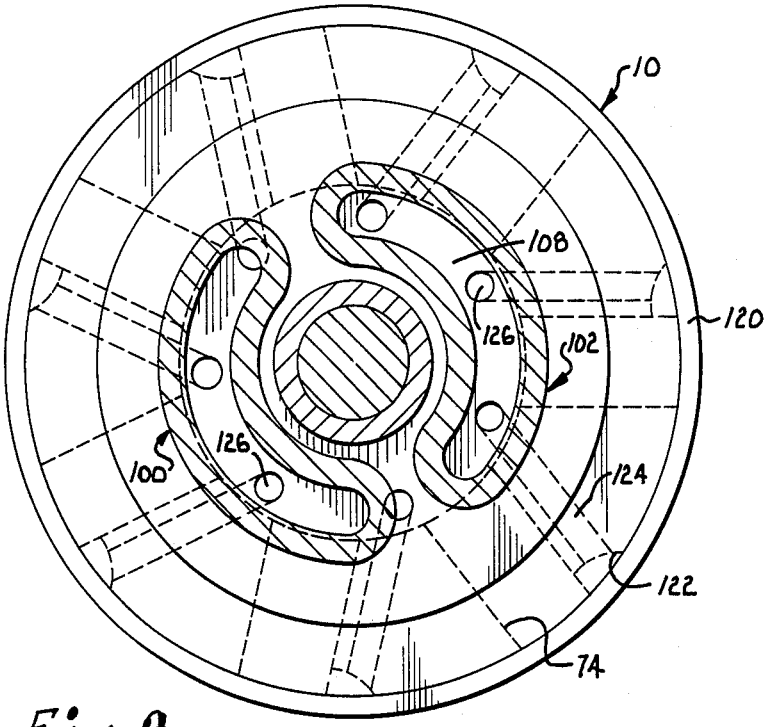
FIG. 3 is a cross-sectional view taken along line 3—3 of FIG. 1, certain chambers and passages in the rotor being shown in phantom.

The construction which achieves this beneficial effect can probably best be explained in reference to FIGS. 1, 2 and 3 of the drawing. The pressurized cavities or chambers 76 during operation of the unit are all either to the left or to the right of an imaginary line bisecting the unit between the respective manifolds 100 and 102, depending on whether the unit is operated as a pump or as a motor. Assuming that the operation is such that the pressurized side is to the right of this line, the force of piston **76*c* against the cam has a clockwise directed component as viewed in FIG. 2, the force of piston 76*e* has about an equal, counterclockwise directed component, and the force of piston 76*c* is at right angles to this imaginary line. The construction of apparatus 10** is such that the movement of the cam to effect changes in piston displacement is along this line. Since the resultant force component of the forces of the pressurized pistons is merely normal to the direction of movement of the cam, the latter can be moved with very little force.

This phenomenon is highly significant. The axial piston units presently in use require power assist structures to make changes in the positioning of the swash plate to effect changes in the displacement of such units. The contruction herein described for apparatus 10 greatly simplifies the changing of the displacement of the unit. Very little effort is required to rotate shaft 68 to effect changes in the displacement of the unit. A lever arm may be operably coupled with the shaft for manually rotating the shaft if desired. On the other hand, should it be desired to change the displacement mechanically, any of a number of readily available, relatively economical devices could be operably coupled with the shaft to rotate the latter and such devices would be relatively small and compact.

The notched element 72 is free to rotate in the arcuate slot or notch in sliding block 62 to maintain the notch of the element aligned with projection 70 irrespective of the position of the block along its rectilinear path of travel. This construction further contributes to the ease by which the displacement of the unit may be varied. The relatively snug fit provided by this construction also insures that the block 62 is held securely in its proper position until a subsequent adjustment may be desired.

Figure 13:
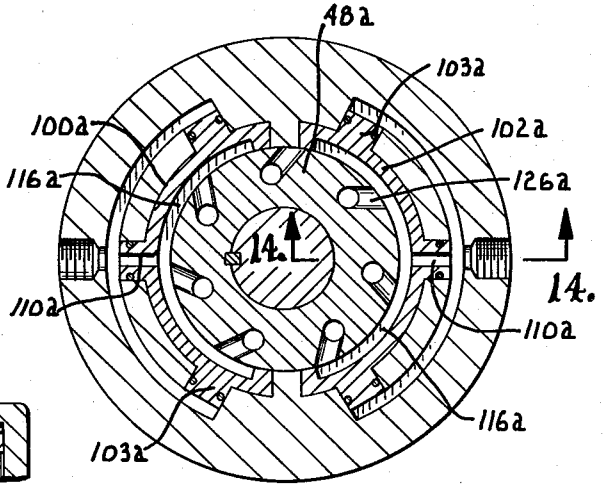
FIG. 13 is a cross-sectional view through an apparatus similar to that shown in FIG. 11 and taken along a line generally at the location of line 12—12 of FIG. 11, but illustrating a still further modification of the fluid porting arrangement.
Figure 14:
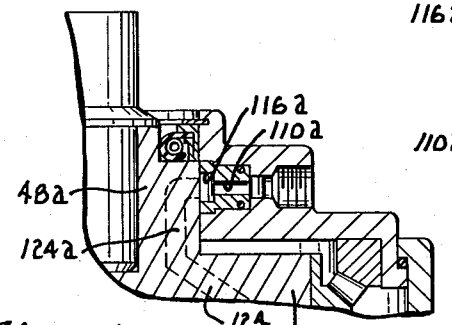
FIG. 14 is a fragmentary, detailed cross-sectional view taken along line 14—14 of FIG. 13.

FIGS. 13 and 14 of the drawing illustrate a slightly modified construction of the sliding connection for communicating fluid to the rotor. The rotor 110 is modified to accommodate extensions **124*a* for each passage 124 and extending upwardly through an otherwise solid rotor extension 48*a* as shown. The manifolds 100*a* and 102*a* are shaped to complementally fit around the transversely circular rotor extension 48*a* with the manifold grooves 116(*a*) facing radially inward in position to communicate with the respective outwardly opening ports spaced circumferentially around the rotor. The housing is appropriately configured to accommodate the piston projections 110*a* and 103*a*** as shown to effect fluid communication to the rotor from the fluid inlet and outlet ports of the unit and to maintain an effective seal between the manifolds and the rotor.

Figure 12:
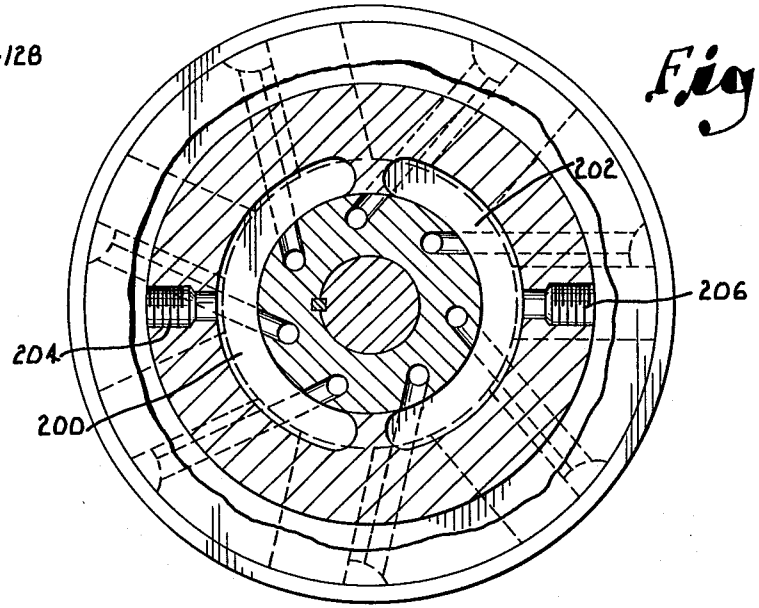
FIG. 12 is a detailed cross-sectional view taken along line 12—12 of FIG. 11, parts being broken away to reveal details of construction.
Figure 11:
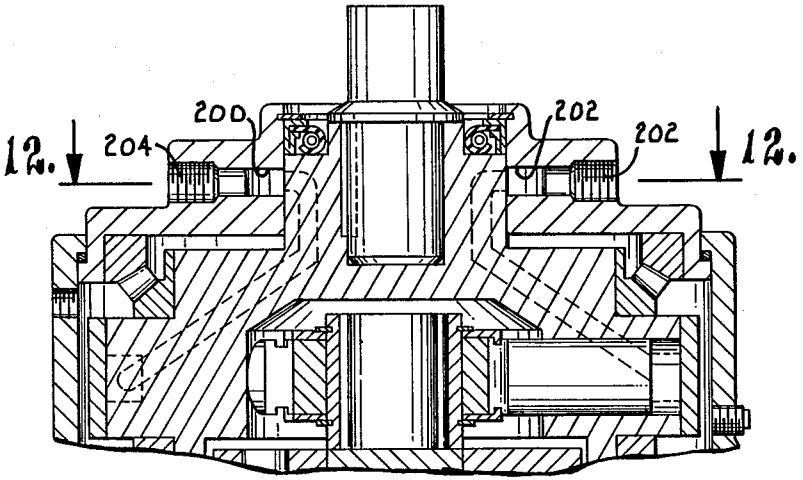
FIG. 11 is a fragmentary view similar to FIG. 1, but on a reduced scale and illustrating a modified fluid porting arrangement.

Still another modified construction to effect communication between the main fluid ports and the chambers in the rotor is shown in FIGS. 11 and 12 of the drawings. No manifold is utilized in this construction. Rather, elongated grooves 200 and 202 are provided in the upper end of the housing as shown in FIG. 12. The grooves communicate with their respective inlet or outlet ports 204 and 206. Again, the elongated fluid passages for the respective cylinders in the rotor terminate in ports which are spaced apart circumferentially and open onto the outer cylindrical surface of the rotor adjacent the housing grooves. As the rotor turns, the rotor ports are sequentially brought into and taken out of fluid communication with the respective grooves as will be understood.

Another embodiment constructed pursuant to certain features of this invention is broadly designated by reference numeral 128 and is illustrated in FIGS. 7, 8, 9 and 10 of the drawings. The housing 130 of apparatus 128 includes a top 132, a main back plate 134 spaced from the top, and an annular rim or side wall 136. A generally flat mounting member 138 is positioned on back plate 134 in the manner shown in FIG. 7.

A rotor 148 having a circular perimeter is received in the internal cavity 140 of the housing. The upper surface 149 of rotor 148 is provided with an elongated, rectangular slot 151 shown best in FIGS. 7 and 9. The rectangular end 153 of a connector 155 fits relatively loosely in slot 153 as shown. The dimensions of the slot and end respectively are such as to permit a relatively large amount of radial shifting of the connector with respect to the axis of the rotor, yet to insure rotation of the connector with the rotor as the latter turns in the cavity.

A rectangular slot 157 oriented 90 degrees from slot 151 is provided in the end of connector 155 opposite end 153. Slot 157 receives the rectangular end 159 of a drive shaft 152 for apparatus 128 and projecting outwardly from the housing. The fit of end 159 in slot 157 is similar to that described for end 149 in slot 151 to permit limited shifting movement between the connector and the drive shaft radially of the longitudinal axis of the latter. Drive shaft 152 is telescoped through a sleeve 161 mounted for rotation on a fixed axis in bearings 163. The design of the shaft drive assembly permits the rotor 148 to rotate freely while within cavity 140 and further prevents radial or thrust forces against shaft 152 from interfering with the positioning of the rotor within the cavity. A seal 176 is provided to prevent the egress of fluid around the collar. Drain ports 165 and 167 are provided in the housing.

Rotor 148 has a plurality of radially extending bores or cylinders 154 spaced circumferentially around the rotor as illustrated. Each cylinder 154 terminates short of the extreme outer periphery of the rotor and is communicated with the outer edge 150 of the rotor by its respective opening 156 as shown.

A piston 158 is fitted in each cylinder 154 with a helical spring 160 interposed between the piston and the outermost end of its respective cylinder to urge the pistons into engagement with the outer surface of a transversely circular cam 142.

Cam 142 is rigidly secured to a circular, stepped plate 144 received in a circular opening in mounting member 138. Plate 144 is, in turn, secured to a shaft 146 projecting through base plate 134 so that plate 144 may be easily turned by rotating shaft 146. Cam 142 is positioned eccentric to plate 144 and the latter is axially aligned with the central axis of the housing cavity 148. Accordingly, it will be readily apparent that rotation of shaft 146 quickly and easily changes the eccentricity of the cam.

Each side of housing 130 is provided with its respective fluid port 162 and 164. The ports 162 and 164 communicate with their respective corresponding elongated grooves 166 and 168 formed in rim 136 immediately outboard of the outer periphery of the rotor. Groove 166 is in fluid communication with port 162 and groove 168 is in fluid communication with port 164. Each groove extends in arcuate fashion through a sufficient portion of chamber 140 to simultaneously communicate with a plurality of the openings 156 for the cylinders 154. In the embodiment illustrated in FIGS. 6 and 7, the grooves 166 and 168 are of equal length. Further, each groove is of sufficient length to simultaneously communicate with three of the openings 156 for the seven cylinders carried by rotor 148.

The components of housing 130 are secured together by cap screws 170 placed peripherally around the apparatus. Egress of fluid from apparatus 128 around shaft 152 is prevented by the provision of seal 176 as shown.

The diameter of rotor 148 is slightly less than the diameter of cavity 140 in which the rotor turns. This permits a very slight amount of lateral movement of "float" normal to the axis of rotation during operation of the apparatus. Such movement would not be possible, however, without the especially constructed drive shaft components wherein the elongated end 153 of connector 155 extends at right angles with the elongated end 159 of drive shaft 152. The two rectangular ends, free to move longitudinally in their respective slots, accommodate this lateral movement as will be understood by those skilled in the art. Since the ends are slightly smaller than the slots in which they are received, the connection between the rotor and the drive shaft is such that a driving relationship is maintained between the two irrespective of the slight axial misalignment which results from this float.

Assuming that apparatus 128 is to be operated as a motor, pressurized fluid is introduced through port 162. The pressurized fluid fills groove 166 and enters those cylinders in fluid communication with the groove. The force of the fluid acting on the cylinders pushes the ends of those cylinders against the outer surface of cam 142. This results in the shifting of the rotor to the left as viewed in FIG. 8, and into tight sealing engagement between the outer edge of the rotor adjacent the groove and the interface of rim 136 in this region.

The total cross-sectional area of the pistons subjected to the pressurized fluid is greater than the surface area of the bottom of groove 166. This insures that the pistons are forced radially inwardly of the rotor and against the cam to shift the rotor into tight sealing engagement against the surface of the housing defining groove 166. This tight sealing engagement effectively seals the juncture between the rotor and the stationary rim at this location to prevent the escape of fluid around the rotor.

As the rotor turns, each succeeding cylinder is brought into fluid communication with groove 166 and ultimately out of such fluid communication when the rotor has turned far enough to advance the cylinder beyond the extreme end of the groove. The length of the groove is such that at least three cylinders are in fluid communication with the groove at all times.

Once a cylinder reaches the beginning of the other groove 168, the fluid in that cylinder is vented through the groove to the outlet port 164. The pressure of the fluid at the outlet side of the apparatus along the margin of groove 168 is sufficiently low that no leakage problem is presented by the slight spacing or clearance which results at this location by the shifting of the rotor into tight engagement against the housing on the high pressure side in the vicinity of the inlet groove 166.

It will be readily apparent to those skilled in the art how apparatus 128 can be utilized as a pump instead of as a motor heretofore described. It suffices to say that the operation of the floating rotor responsive to the pressurized fluid in the cavity for sealing against the egress of pressurized fluid around the rotor is comparable to that heretofore described when the apparatus is operated as a motor.

Apparatus 128 illustrates another example wherein the pressure of the fluid provided to the apparatus is utilized to effect a fluid tight seal between the stationary and the rotating components of the apparatus. Leakage at the juncture of the input of pressurized fluid to the apparatus is minimized by this construction in a simple and effective manner whereby the overall efficiency of operation of the apparatus is substantially improved.

Apparatus 128 is constructed in a manner susceptible of relatively inexpensive fabrication so that the cost of the unit can be kept to an absolute minimum and far less than other units having the same or similar capabilities. The primary applications contemplated for apparatus 128 are relatively low speed operations wherein the effects of centrifugal force on the flow of fluid through the unit will not be substantial.

The displacement of apparatus 128 can be quickly and easily changed by rotating shaft 146 in a manner similar to that heretofore described with respect to adjustment of the displacement of apparatus 10.

Figure 10:
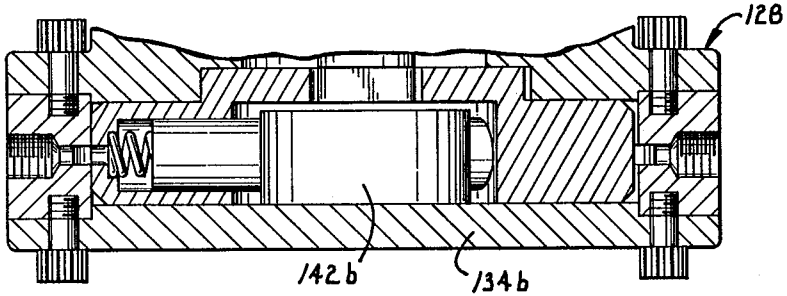
FIG. 10 is a fragmentary view similar to FIG. 7, but on a reduced scale and illustrating a modified baseplate having a fixed position cam.

FIG. 10 illustrates one way in which particularly desirable benefits may be achieved from the relative simplicity of the construction of apparatus 128. The cam **142*b* for the unit shown in FIG. 10 is rigidly secured to the main back plate 134*b* of this unit. The remaining components of the unit may be identical to those heretofore described with respect to the construction shown in FIGS. 7, 8 and 9** of the drawings.

A manufacturer can, therefore, fabricate a number of base plates **134*b* having the cams 142*b*** affixed to the base plates at various degrees of eccentricity. The manufacturer then can select the appropriate base plate and cam combination to meet the particular displacement specifications required by the purchaser. Further, if it is desired to modify a unit from the displacement previously provided, the original base plate can be quickly and easily removed and a new base plate having the cam at a different location to provide the different displacement can be installed in its place. The economies of fabrication heretofore described and which will be appreciated by those skilled in the art are achieved, however, without sacrificing the efficiency of operation of the unit.

Having thus described the invention I claim:

1. A radial piston force transmitting apparatus for effecting a relationship between torque and fluid pressure, said apparatus comprising:

a housing enclosing a circular chamber and having an inlet opening and an outlet opening:

a circular rotor mounted for rotation within the chamber, said rotor containing a plurality of spaced apart cylinders extending radially of the rotor;

a piston in each cylinder respectively;

a cam mounted for eccentric positioning within the housing and operably connected with said pistons for causing reciprocation of the latter in their respective cylinders during each revolution of the rotor;

said rotor having a fluid passage for each cylinder respectively, communicating with the outer end of its corresponding cylinder;

each of said passages having a port in the said rotor spaced radially inwardly from the outer periphery of the rotor;

said ports being arranged in spaced apart, annular configuration about the axis of rotation of the rotor;

porting means for the inlet opening and for the outlet opening respectively, each porting means simultaneously intercommunicating a plurality of ports with its respective opening for transfer of fluid to and from the cylinders during rotation of the rotor;

said porting means including a pair of manifolds each having an elongated peripheral edge defining an elongated groove extending along the path of movement of the said ports during rotation of the rotor, said grooves being of sufficient length to communicate simultaneously with a plurality of said ports;

said manifold edges being complementally engaged in sliding relationship against a surface of the rotor to effect a sliding seal between the manifold and the rotor;

means communicating one of the said manifolds with the fluid inlet and the other manifold with the fluid outlet whereby the sliding engagement between the manifold edges and the rotor surface effects a seal for the transfer of fluid between the cylinders and the respective fluid inlet and outlet during rotation of the rotor; and a mounting member disposed in the housing, there being a rectangular opening in said member, a rectangular block slidably received in the opening and having a shorter length than the latter to permit rectilinear movement of the block longitudinally of the opening, said cam being carried by the block for movement therewith, and means operably coupled with the block and projecting exteriorly of the housing for sliding the block to any position along its path of travel to adjust the eccentricity of the cam with respect to the rotor, said block having a notch with a circular side wall extending into the block from one longitudinal edge of the latter, said sliding means including an element complementally and rotatably received in the notch, and means operably coupled with the element for rotating the latter to effect said sliding of the block.

* * * * *